United States Patent [19]

Eckhardt et al.

[11] 4,239,970

[45] Dec. 16, 1980

[54] RADIONUCLIDE GENERATOR

[75] Inventors: Wolfram Eckhardt, Tegernheim; Johann Hausladen, Regensburg, both of Fed. Rep. of Germany

[73] Assignee: E. R. Squibb & Sons, Inc., Princeton, N.J.

[21] Appl. No.: 937

[22] Filed: Jan. 4, 1979

[30] Foreign Application Priority Data

Jan. 5, 1978 [DE] Fed. Rep. of Germany ..... 2800496

[51] Int. Cl.[3] ..... G21G 1/00

[52] U.S. Cl. ..... 250/432 PD; 210/284; 210/285; 210/286; 250/437; 252/301.1 R; 422/159

[58] Field of Search ..... 252/301.1 R; 250/432 PD, 437; 422/159; 210/284, 285, 286; 423/2

[56] References Cited

U.S. PATENT DOCUMENTS

| | | | |
|---|---|---|---|
| 2,790,512 | 4/1957 | Dow | 55/74 |
| 3,749,556 | 7/1973 | Barak et al. | 422/159 |
| 3,970,583 | 7/1976 | Panek-Finda | 423/2 |
| 4,041,317 | 8/1977 | Morcos et al. | 250/432 PD |
| 4,123,508 | 10/1978 | Mandrin | 422/159 |

*Primary Examiner*—Deborah L. Kyle
*Attorney, Agent, or Firm*—Lawrence S. Levinson; Donald J. Barrack

[57] ABSTRACT

The radiation shielding surrounding a radionuclide generator of the parent-daughter type can be minimized if the containing means used to contain the support medium onto which is adsorbed the parent nuclide defines a curved path.

8 Claims, 8 Drawing Figures

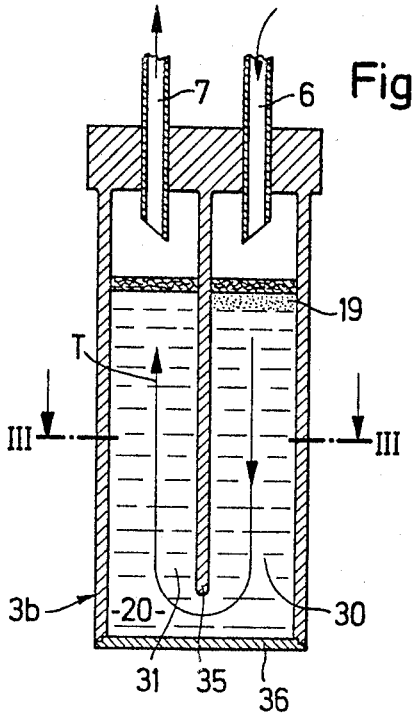
Fig. 3a
Fig. 3b
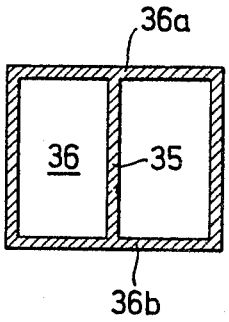
Fig. 4
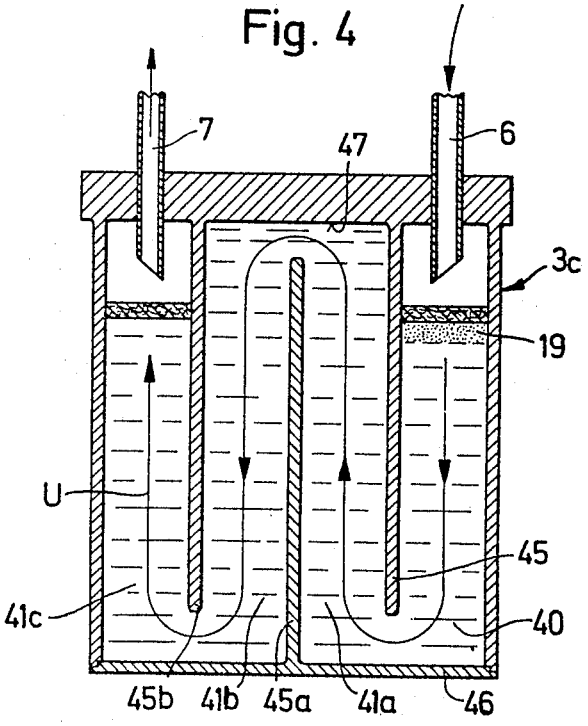

BRIEF DESCRIPTION OF THE DRAWINGS

FIG. 3*a* is a generator column of a radionuclide generator with two rectangular chambers in longitudinal section.

FIG. 3*b* is a cross sectional view of the generator column with rectangular chambers along line III—III in FIG. 3*a*.

FIG. 4 is a generator column of a radionuclide generator with four rectangular chambers in longitudinal section.

DETAILED DESCRIPTION OF THE INVENTION

Figure 1A:
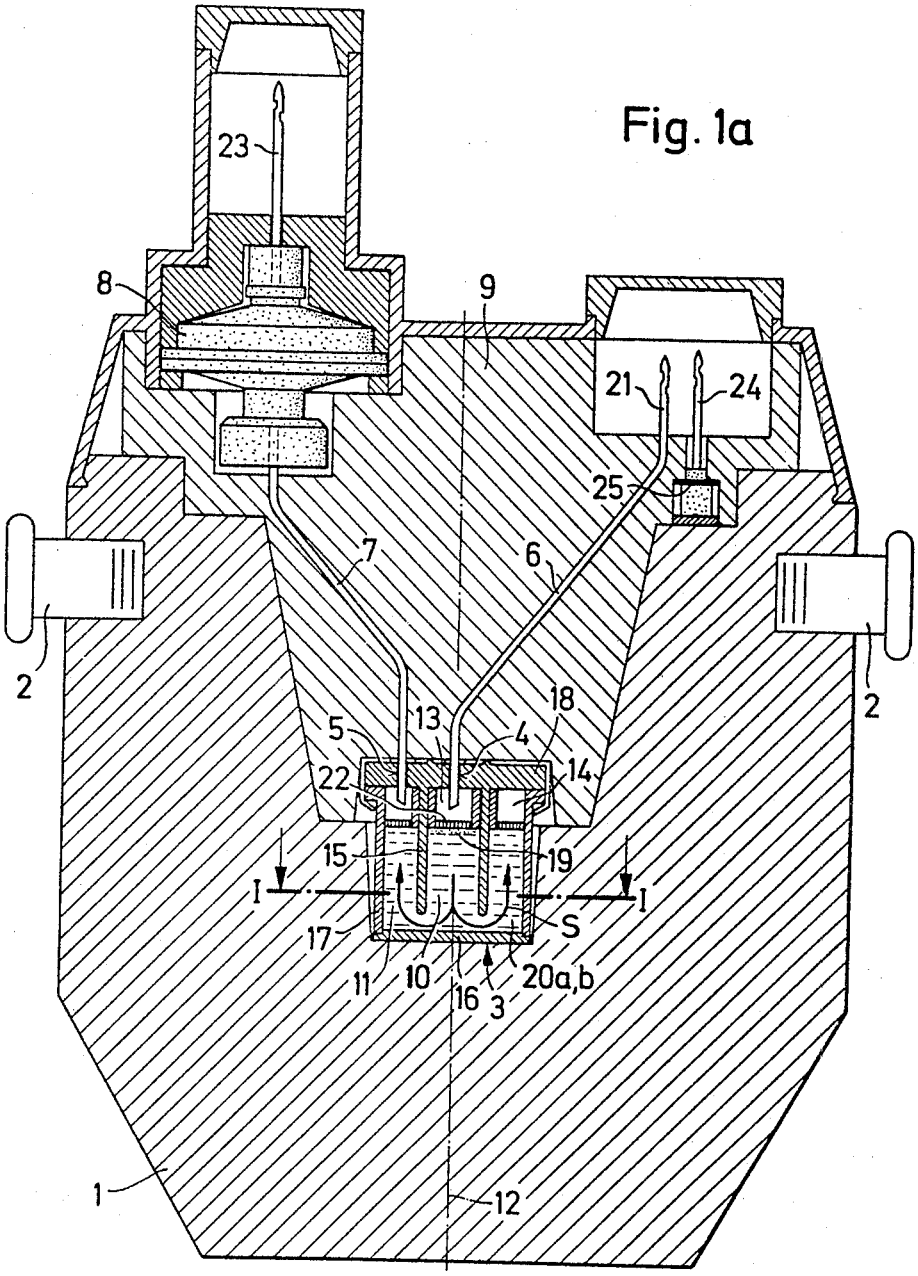
FIG. 1*a* is a radionuclide generator with two concentric cylindrical chambers and shielding in longitudinal section.

According to FIG. 1*a* a radionuclide generator in accordance with the invention has shielding 1 against radioactive radiation, e.g., lead shielding, on which supports 2 are provided for transportation of the generator. Approximately in the center of the shielding 1 a cavity is provided, whose dimensions are such that the actual generator column 3 can fit inside of it. This generator column has an inlet opening 4 and an outlet opening 5, to which an inlet line 6 for introducing the wash solution or eluant and an outlet line 7 for carrying away the washing solution or eluate charged with the desired isotope is respectively connected. In the outlet line 7 a filter 8 is provided, which assures that the eluate coming from the generator column 3 is sterile and free from unwanted particles and is suitable for direct injection into patients for diagnostic purposes. For complete shielding of the generator column 3, a shielding insert 9 is provided on the open side of the shielding 1, which for example, can also be made of lead, and through which the inlet and outlet lines 6 and 7 are suitably passed.

Figure 1B:
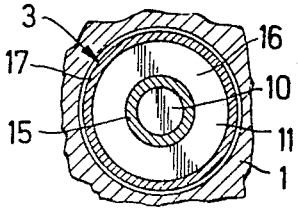
FIG. 1*b* is a cross sectional view of the generator column of the radionuclide generator along line I—I in FIG. 1*a*.

The actual generator column 3 according to FIGS. 1*a* and 1*b* consists of a central cylindrical chamber 10 and an annular cylindrical chamber 11 concentrically surrounding it, the common axis of which 12 is preferably also the axis of symmetry of the shielding 1. The position of the axis 12 of the generator column 3 in and of itself is arbitrary, but it is preferred to arrange this axis 12 vertically, so that in this case the introduction of the eluant through the inlet opening 4 and the withdrawal of the eluate through the outlet opening 5 can advantageously be carried out at the upper end of the cylindrical column 3.

The two chambers 10 and 11 connected at their lower end are formed in that a cylindrical partition 15 is concentrically located in the cylindrical container 17 of the generator column 3, and is fastened to the cover 18 of the generator column 3. However, the free end of the partition 15 does not reach the bottom 16 of the container 17, so that a connection is produced between the two chambers 10 and 11 by means of the free space between the separating wall 15 and the bottom 16.

The two chambers 10 and 11 are almost completely filled with adsorbant material (the support means for the parent nuclide) 20*a, b,* for example, aluminum oxide with different pH values in the two chambers. At the upper end of the cylindrical chamber 10, which is connected to the inlet line 6 for the eluant, the parent nuclide 19, for example $^{99}$Mo, is introduced.

When the eluant (for example hydrochloric acid or a sodium chloride solution) is introduced through the inlet cannula 21, by way of the inlet line 6 and the inlet opening 4 into the inlet chamber 13, it may enter the cylindrical chamber 10 through an inlet filter 22 which is preferably provided. The eluant takes up the desired daughter nuclide ($^{99m}$Tc when the parent nuclide is $^{99}$Mo) there and is withdrawn in the direction of the arrow S by way of the annular cylindrical chamber 11 into the outlet chamber 14, and then through the outlet line 7, the filter 8 and the outlet cannula 23. As a result of the curved flow path S of the elution solution, a long adsorption path is obtained despite the small dimensions of the generator column. Therefore, it is possible to make the shielding 1 with the shielding insert 9 relatively short in the direction of the axis 12 as well.

Because of the cylindrical design of the generator column 3 as described, it is advantageous for geometric reasons to select the height of the generator column 3 to equal its diameter, since in this case the external dimensions are minimal for a given volume of the generator column 3. This is also true for the cylindrical designs of the generator columns according to FIGS. 2*a,* 2*b* and 5.

Finally in the case of the radionuclide generator according to FIG. 1*a,* a suction cannula 24 is provided, through which air can be drawn into the eluant bottle placed on cannulas 21 and 24 during elution. This suction cannula 24 is preferably provided with a filter 25, so that the air drawn in is sterile.

Figure 2A:
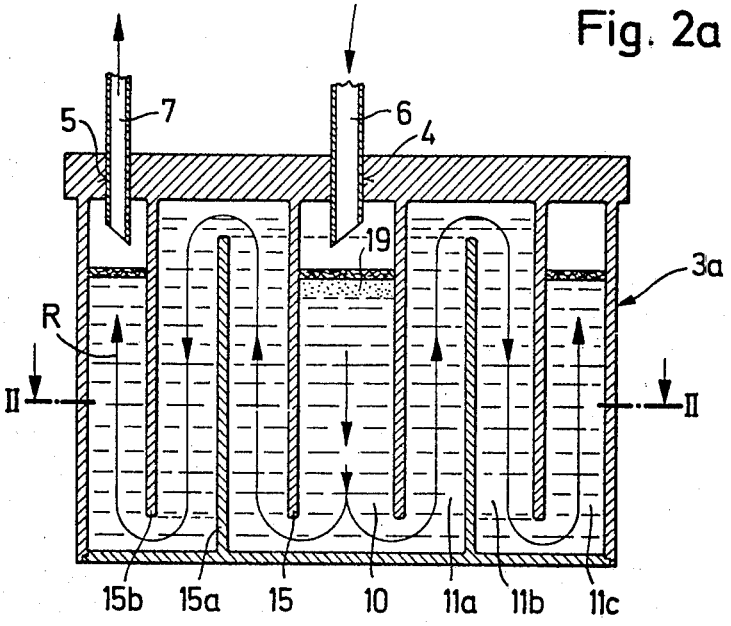
FIG. 2*a* is a radionuclide generator with four concentric cylindrical chambers in longitudinal section.
Figure 2B:
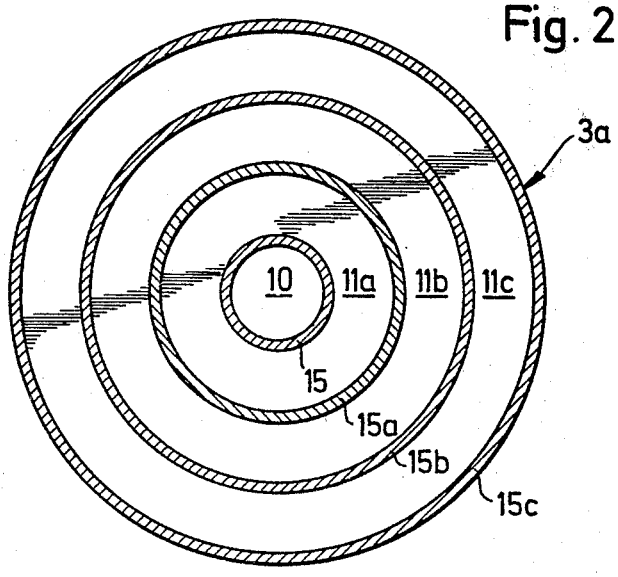
FIG. 2*b* is a cross sectional view of the generator column of the radionuclide generator along line II—II in FIG. 2*a*.

In the embodiment according to FIGS. 2*a* and 2*b,* in addition to the central cylindrical chamber 10 a total of three annular cylindrical chambers 11*a,* 11*b,* 11*c* are provided, wherein the walls 15*a,* 15*b* and 15*c* are arranged such that the flow path of the elution solution follows a winding down, up, down, up path R in a longitudinal section through the generator column 3*a.* The effective adsorbant length is practically doubled in the case of identical height of the generator column compared to the embodiment of FIG. 1. The various chambers 10, 11*a,* 11*b* and 11*c* are preferably provided with absorbant materials of different pH's.

In the embodiment according to FIGS. 3*a* and 3*b* the chambers 30 and 31 of the generator column 3*b* filled with adsorbant material 20 are not cylindrical but are constructed adjacent to one another, preferably rectangular in form. In this case the partition 35 connects the two side walls 36*a* and 36*b,* but does not reach the bottom 36 of the generator column 3*b.* The resulting flow path of the elution solution is labeled with a T in FIG. 3*a.*

The principle of a generator column explained by means of FIGS. 3*a* and 3*b* can also be carried over to the embodiment shown by FIG. 4 where there are several chambers 40, 41*a,* 41*b* and 41*c* connected in succession. As shown in FIG. 4 the partitions 45, 45*a* and 45*b* connect the two opposite side walls of the housing of the generator column 3*c,* in each case leaving a free space between the bottom 46 and cover surface 47. This

RADIONUCLIDE GENERATOR

BACKGROUND OF THE INVENTION

The invention pertains to a radionuclide generator of the parent-daughter type. The generator comprises a column which contains an adsorbant material which acts as a support for the parent nuclide with an inlet and outlet opening connected to inlet and outlet lines. To wash out (elute) at least one desired redioactive substance from the generator a washing solution (eluant) is introduced into the inlet line and the washing solution charged with the desired radioactive substance (eluate) emerges at the outlet line.

The use of radionuclides for the diagnosis and treatment of various medical conditions is widespread. However, some radioactive isotopes have an extremely short half life, so that their use may not be practical because of the time required to transport the material from the location of manufacture to the physician performing the treatment. For medical reasons, however, it is often desirable to use precisely these shortlived isotopes in nuclear medicine, in order to avoid prolonged radiation exposure of the patient. For example the technetium isotope $^{99m}$Tc with its relatively short half life of about 6 hours is widely used in scanning and visualizing various organs in the body. Because of its short half life the physiological damage which may result from the use of radionuclides is largely eliminated or at least minimized.

In order to prepare such short-lived radionuclides for the physician, radionuclide generators of the type described above are known; see for example, U.S. Pat. No. 4,041,317, in which the generator column is formed as a hollow cylinder with a circular cross section and a vertical axis. In the area of the upper end of this generator column, the inlet opening is provided with an appropriate inlet line for the rinse solution (eluant). The generator column is provided with an adsorbant material, for example aluminum oxide (alumina), which is a support medium for the parent nuclide of the desired radionuclide. If, for example, $^{99m}$Tc is selected as the daughter nuclide for the medical treatment as mentioned above, the molybdenum isotope $^{99}$Mo is used as the parent nuclide. By introducing the rinse solution into the generator column containing the parent nuclide (e.g., $^{99}$Mo), the daughter nuclide (e.g., $^{99m}$Tc) is eluted from the generator. The solution thus obtained, with the desired daughter nuclide, is called the eluate.

In order to achieve the greatest possible efficiency, i.e., the cleanest separation, in elution of a desired daughter nuclide, it is desirable to provide the longest possible path for the eluant to travel through the material onto which the parent nuclide is adsorbed. However, when known elongated generator columns are used, considerable problems in the shielding of the column arise. In order to fulfill the radiation protection specifications for an elongated generator column, the shielding (usually lead) must be similarly long, in order to guarantee the necessary adsorption length for the radiation to be held back at each point. The amount of material provided for shielding in the case of such a design (i.e., elongated columns) is greater the longer the generator column is in comparison to its diameter. On the other hand, it is desirable, in order to facilitate handling and transport, to keep the total weight of the radionuclide generator (to which the shielding is the principal contributor) as small as possible.

BRIEF DESCRIPTION OF THE INVENTION

The goal of this invention is to provide a radionuclide generator of the type described above such that the amount of shielding can be kept as small as possible, thus minimizing both manufacturing and transportation expenses.

In solving this problem the invention proceeds from the basic concept of providing dimensions of the generator column in the three coordinate directions which are identical, or as nearly similar as possible, without having to accept a reduction in efficiency with respect to separation of the desired daughter nuclide. The generator of this invention is characterized by a column wherein the length necessary for an efficient separation of the radionuclide is obtained by having the column curved between the inlet and outlet openings. This type of geometry of the effective generator column, while providing equal efficiency in the separation process, reduces the mass of shielding material required for adequate shielding. The optimal geometric form is obtained with spherical external dimensions of the generator column, which in this case can be achieved, for example, by designing the column as a spherically wound pipe.

In practice, however, it is generally sufficient for the external dimensions of the generator column in the various coordinate directions to be approximately the same. Therefore, in accordance with one embodiment of the invention the generator column is formed by at least two concentric column segments, which are connected at one axial end to the adjacent column, wherein the inlet opening and the outlet opening are located at the other axial end of the innermost and outermost column segments. This means that the different column segments surround one another successively in the form of rings, wherein the connections between the successive column segments are provided alternatively at the two axial ends of each column segment. Since the inlet opening and the outlet opening are provided respectively at the radially innermost and radially outermost ends of the column or vice versa, the eluant alternately passes through column segments directed parallel to the longitudinal column axis and radially, wherein the flow direction is opposite in adjacent column segments parallel to the column axis. As a result of this reversal of the flow direction with short radially directed column segments, a large effective adsorbtion length is achieved in a small space.

In another embodiment the generator column can be formed by at least two adjacent chambers connected by a connecting channel, whose inlet and outlet openings are located in different chambers at the furthest points from the connecting channel. In an embodiment of this type the symmetry is not as great as in the previously described embodiment, so that more extensive shielding is necessary compared to the preferred embodiment of this invention, but the amount of shielding required is still considerably less than that required in the known radionuclide generator with a cylindrical generator column and without a reversal of the flow direction within the adsorbant material.

In accordance with one embodiment of this invention, adsorbant material of different pH's is provided in the various sections of the generator column. As described in U.S. Pat. No. 4,041,317 the support medium can be made up of multiple layers of alumina each having a different pH.

results in the flow path U shown in FIG. 4 for the elution solution.

Figure 5:
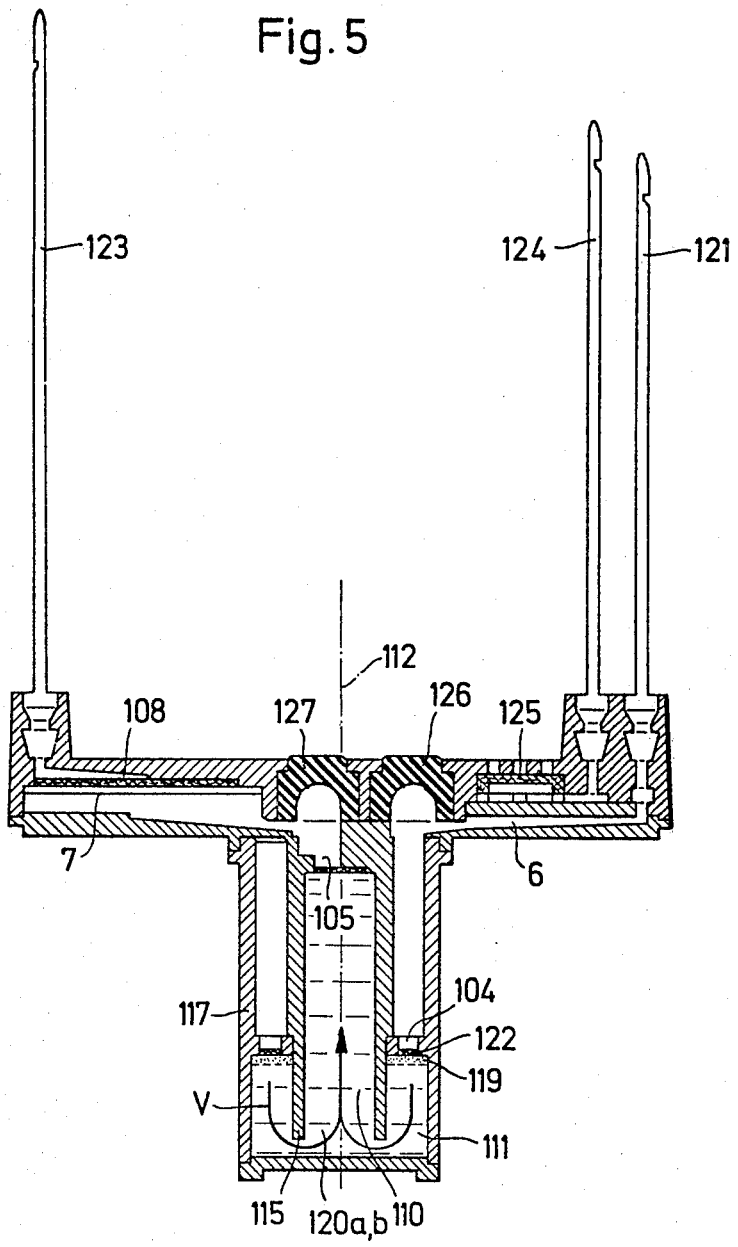
FIG. 5 is a radionuclide generator with two concentric cylindrical chambers without shielding in a longitudinal section in another embodiment.

FIG. 5 shows another embodiment of the generator column, which like the embodiment of FIG. 1 has a cylindrical container 117, a central cylindrical chamber 110, and an annular cylindrical chamber 111 concentrically surrounding it. The cylindrical partition 115 corresponds to the partition 15 in the embodiment of FIG. 1. As shown in FIG. 5, the parent nuclide 119 can be introduced at the top of the annular cylindrical chamber 111 into the adsorbant material 120*a, b*. In this embodiment the elution solution flows from the outer annular cylindrical chamber 111 to the inner cylindrical chamber 110, as is indicated by the arrow V. For introducing the elution solution an inlet cannula 121 is provided, which passes into the inlet line 6, which is connected to the inlet opening 104 of the annular cylindrical chamber 111. The withdrawal of the eluate containing the desired daughter nuclide takes place through the outlet opening 105, the outlet line 7 and the outlet cannula 123, wherein a filter 108 can be provided between the outlet line 7 and the outlet cannula 123 to make sure that the eluate is kept sterile.

In order to draw air into the eluant bottle, a suction cannula 124 is provided, which is connected to the environment of the generator column by way of a filter 125, so that the air drawn in is sterile.

The charging of the generator column with the solution of the parent nuclide is carried out by way of a pierceable rubber stopper 126, which is advantageously located above the inlet opening 104 with a sterile filter 122, so that a piercing cannula can be introduced parallel to the axis 112 of the generator column above the inlet opening 104. Correspondingly, in order to draw up the residual solution now free from parent nuclide, a pierceable rubber stopper 127 is provided above the outlet opening 105, through which a corresponding piercing cannula can be introduced to draw up the solution.

Due to considerations of radiation protection it is advantageous not to fill the annular cylindrical chamber 111 up to the top of the generator column with adsorbant material, since most of the radiation is concentrated in the first few millimeters below the inlet opening 104, i.e., in the initial volume of the adsorbant material. The use of a multiple pH alumina support medium reduces this problem.

Both the areas of the suction cannula 124 and the outlet cannula 123 are closed off by the filters 125 and 108 and the radially outermost projection of the inlet cannula 121 will remain sterile even during the filling of the radionuclide generator column, which is accomplished with a piercing cannula through the pierceable rubber stopper 126, located radially further inward. The corresponding facts also apply to withdrawal by suction of any residual solution with by means of a piercing cannula passed through the pierceable rubber stopper 127.

What is claimed is:

1. Apparatus for the generation of a daughter radionuclide from a parent nuclide comprising a support medium for adsorption of the parent nuclide, means for containing said support medium, inlet means for introducing eluant and outlet means for removing eluate, wherein the containing means defines a curved path for the passage of eluant through the support medium between inlet and outlet means.

2. Apparatus in accordance with claim 1 wherein the means for containing the support medium comprises two concentric column segments, connected together at one axial end, and wherein the inlet means and outlet means are located at the other axial end of the column segments.

3. Apparatus in accordance with claim 2 wherein the inlet means is connected to the inner column segment and the outlet means is connected to the outer column segment.

4. Apparatus in accordance with claim 2 wherein the inlet means is connected to the outer column segment and the outlet means is connected to the inner column segment.

5. Apparatus in accordance with claim 2 wherein the column sections have cylindrical cross sections.

6. Apparatus in accordance with claim 1 wherein the means for containing the support medium comprises two side by side connected chambers.

7. Apparatus in accordance with claim 1 wherein the support medium is aluminum oxide.

8. Apparatus in accordance with claim 7 wherein the parent nuclide is molybdenum-99 and the daughter radionuclide is technetium-99m.

* * * * *